US006969806B2

(12) United States Patent
Dupriest

(10) Patent No.: US 6,969,806 B2
(45) Date of Patent: Nov. 29, 2005

(54) CABLE AND METHOD

(75) Inventor: Charles Donald Dupriest, Arlington, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 143 days.

(21) Appl. No.: 10/156,520

(22) Filed: May 28, 2002

(65) Prior Publication Data

US 2003/0221861 A1 Dec. 4, 2003

(51) Int. Cl.[7] ..... H01B 7/08
(52) U.S. Cl. ..... 174/117 F
(58) Field of Search ..... 174/117 F, 117 FF, 174/36, 117 A, 254, 255

(56) References Cited

U.S. PATENT DOCUMENTS

| | | | | |
|---|---|---|---|---|
| 4,028,509 A | | 6/1977 | Zurcher | 200/5 A |
| 4,155,613 A | * | 5/1979 | Brandeau | 439/90 |
| 4,336,536 A | * | 6/1982 | Kalt et al. | 345/85 |
| 4,357,750 A | * | 11/1982 | Ostman | 29/847 |
| 4,435,614 A | | 3/1984 | McAusland | 174/117 |
| 4,530,729 A | * | 7/1985 | Fuchs et al. | 156/217 |
| 4,587,719 A | | 5/1986 | Barth | 29/577 |
| 4,715,928 A | | 12/1987 | Hamby | 156/630 |
| 4,928,206 A | | 5/1990 | Porter, et al. | 361/385 |
| 5,003,126 A | * | 3/1991 | Fujii et al. | 174/36 |
| 5,028,473 A | | 7/1991 | Vitriol, et al. | 428/137 |
| 5,130,499 A | | 7/1992 | Dijkshoorn | 174/254 |
| 5,398,163 A | | 3/1995 | Sano | 361/749 |
| 5,428,187 A | * | 6/1995 | Crane et al. | 174/36 |
| 5,527,998 A | | 6/1996 | Anderson, et al. | 174/255 |
| 5,800,650 A | | 9/1998 | Anderson, et al. | 156/150 |
| 5,831,828 A | | 11/1998 | Cutting, et al. | 361/704 |
| 5,917,158 A | | 6/1999 | Takao, et al. | 174/254 |
| 6,055,713 A | * | 5/2000 | Genei | 29/401.1 |
| 6,061,245 A | | 5/2000 | Ingraham, et al. | 361/749 |
| 6,080,935 A | * | 6/2000 | Lanoue et al. | 174/117 F |
| 6,256,203 B1 | | 7/2001 | Ingraham, et al. | 361/720 |
| 2002/0060087 A1 | * | 5/2002 | Ueno | 174/117 F |

FOREIGN PATENT DOCUMENTS

| | | | |
|---|---|---|---|
| GB | 2034102 | | 5/1980 |
| JP | 1257389 | | 10/1989 |
| JP | 2-78107 | * | 3/1990 |
| JP | 11-185894 | * | 7/1999 |
| WO | WO9607301 A1 | | 3/1996 |

* cited by examiner

*Primary Examiner*—Chau N. Nguyen
(74) *Attorney, Agent, or Firm*—Daren C. Davis; James E. Walton

(57) ABSTRACT

A cable includes a first portion, a second portion, and a first fold between the first portion and the second portion. The cable further includes a first shim bonded between the first portion and the second portion. A method for making a cable includes adhesively bonding a first surface of a first shim to a first surface of the cable, folding the cable over the first shim, and adhesively bonding the first surface of the cable to a second surface of the first shim. A method includes folding a cable and adhesively bonding a shim in the fold to the interior surfaces defined by the fold.

54 Claims, 11 Drawing Sheets

508
506
502
504
206
306
302
304
204
104

308
306
302
304
206
204
104
118
112
118
116
204
120
100
206
202
102
104
III
III 118
112
118
116
204
100
120
206
102
402
V
V

CABLE AND METHOD

BACKGROUND OF THE INVENTION

1. Field of the Invention

This invention relates to a cable and its method of manufacture and, more particularly, to a folded cable and its method of manufacture.

2. Description of the Related Art

Cables generally are used as pathways for transmitting signals to and from equipment. For example, an electrical cable or an optical fiber cable may interconnect two computers so that data may be shared between the computers. Signals corresponding to the data to be shared are transmitted via conductors (e.g., electrical conductors or fiber optic conductors) within the cable. Conductors within cables may also be used as pathways to supply power to equipment.

Historically, such cables have been made of individual conductors arranged in a generally round bundle and sheathed by shielding and/or insulating jackets. Ends of the conductors may be soldered, crimped, or otherwise mechanically attached to connectors that mate with connectors on the equipment to be interconnected. Such attachments may, over time, loosen due to cable flexure or to vibrations imposed on the cable as a result of the environment in which the cables are used.

Further, such cables tend to be large in diameter if they contain large numbers of conductors, which may impair the flexibility of the cable. These types of cables may also be heavy, which may be less desirable in applications such as aircraft, missiles, or the like where weight is a prime design factor.

Flexible printed wiring cables may overcome some of the flexibility and weight issues found in round conventional cables. However, such cables are generally limited in the number of conductors that they may contain. Further, it may be difficult to shield this type of cable from aggressive electromagnetic interference ("EMI").

Flexible printed wiring cables have been made using photolithography and etching processes, similar to those used in the printed circuit board industry. For example, such cables may be made from panels comprising a layer of photosensitive material covering a layer of copper (or other conductor) plated onto a dielectric substrate. Generally, an image of the desired conductor pattern may be transferred onto the photosensitive layer. The portion of the photosensitive material not covering the conductor pattern is washed away, and the panel is acid etched to remove the uncovered copper. The remaining photosensitive material may then be washed away, leaving the conductor pattern exposed. A dielectric layer is generally applied over the conductor pattern to electrically insulate the conductors.

Lengths for such cables have traditionally been limited to the size of the panel being used as raw material in the process. Single substrate cables, having conductors either on one or both sides of the substrate, have been made in serpentine patterns and then folded sharply along fold lines to form cables that can span longer distances. Overlapping areas in the cable may be adhesively bonded together to retain the cable in a folded configuration. Such cables have been generally limited to a single substrate, as described above, due to the sharpness of the fold. Thus, these cables are also limited in the number of conductors that they may include.

Accordingly, a need exists for a lightweight, flexible cable that may include a great number of conductors and that may be manufactured at a reasonable cost. The present invention is directed to overcoming, or at least reducing, the effects of one or more of the problems set forth above.

SUMMARY OF THE INVENTION

In one aspect of the present invention, a cable is provided. The cable includes a first portion, a second portion, and a first fold between the first portion and the second portion. The cable further includes a first shim bonded between the first portion and the second portion.

In another aspect of the present invention, a method for making a cable is provided. The method includes adhesively bonding a first surface of a first shim to a first surface of the cable, folding the cable over the first shim, and adhesively bonding the first surface of the cable to a second surface of the first shim.

In yet another aspect of the present invention, a cable is provided. The cable includes a body having a fold with a bend radius and means for defining the bend radius of the fold.

In a further aspect of the present invention, a method is provided. The method includes folding a cable and adhesively bonding a shim in the fold to the interior surfaces defined by the fold.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
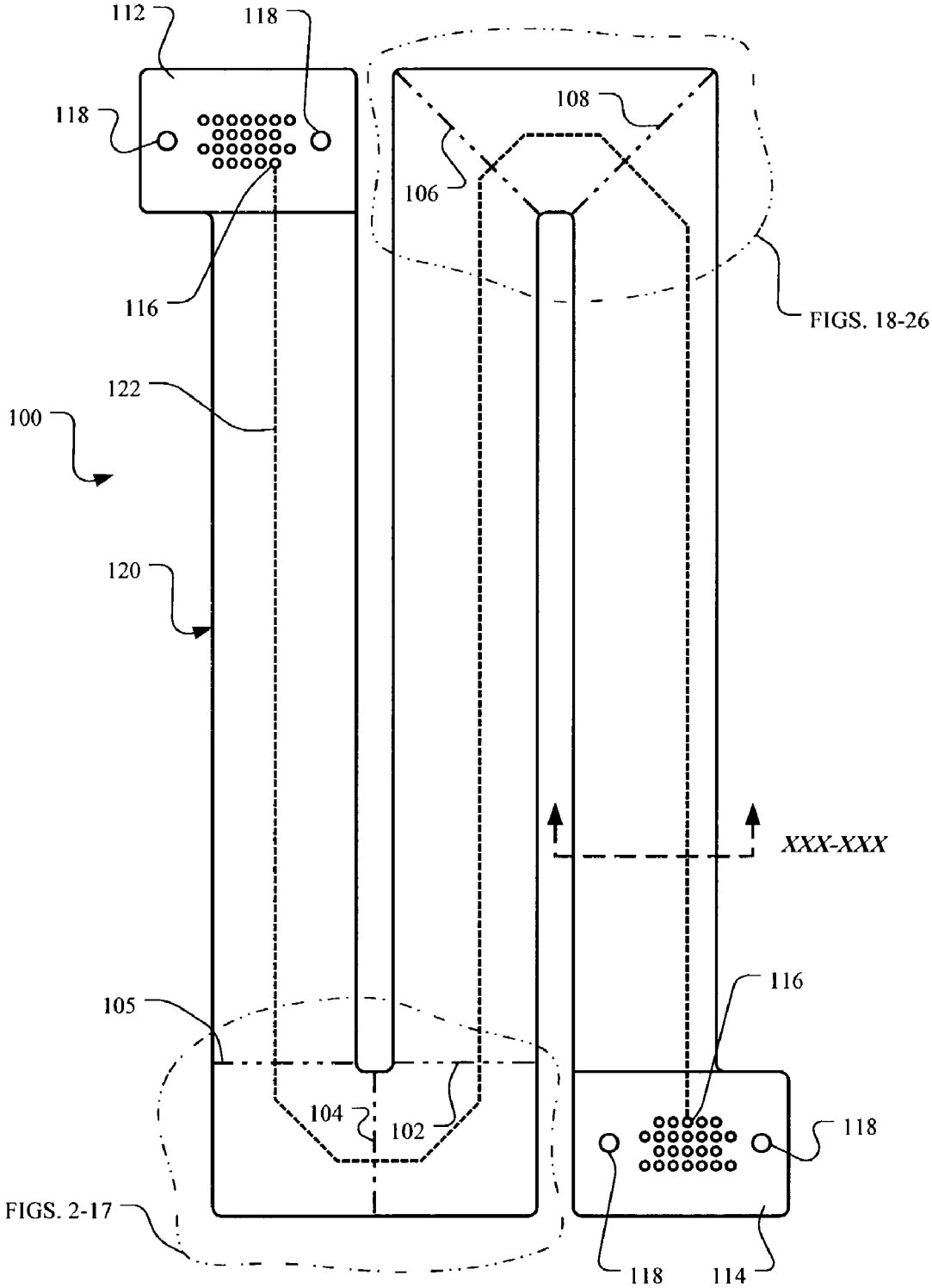
FIG. 1 is a stylized, top, plan view of an cable according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1 illustrates a cable 100 according to the present invention having a serpentine shape that may be selectively folded along fold lines 102, 104, 105, 106, 108 into an elongated form. The cable 100 may be an electrical cable, an optical fiber cable, or any other desired type. In the illustrated embodiment, the cable 100 includes an intermediate portion 120 extending between a first connector 112 and a second connector 114, each having a plurality of contacts 116 (one indicated in each connector 112, 114). The contacts 116 are provided so that connectors (not shown) may mated to the connector attachment areas 112, 114. The illustrated embodiment also includes openings 118 through the connector attachment areas 112, 114 so that the cable 100 may be mechanically attached to equipment to which it is coupled.

While the illustrated embodiment provides contacts 116 and openings 118 having certain geometric configurations, the scope of the present invention encompasses a cable 100 having any desired geometric configuration of contacts 116 and openings 118 or that omits some or all of the contacts 116 and/or the openings 118. Further, the scope of the present invention encompasses a cable 100 that omits one or both of the connector portions 112, 114. The contacts 116 may be interconnected by the conductors within the cable 100, as depicted by the conductor 122. In one embodiment, the cable 100 includes a plurality of layers of electrical or optical fiber conductors, such as the conductor 122. The scope of the invention is not limited by the number, construction, or configuration of connectors (e.g., connectors 112, 114) for the cable 100.

Figures 2, 3, 4, 5:
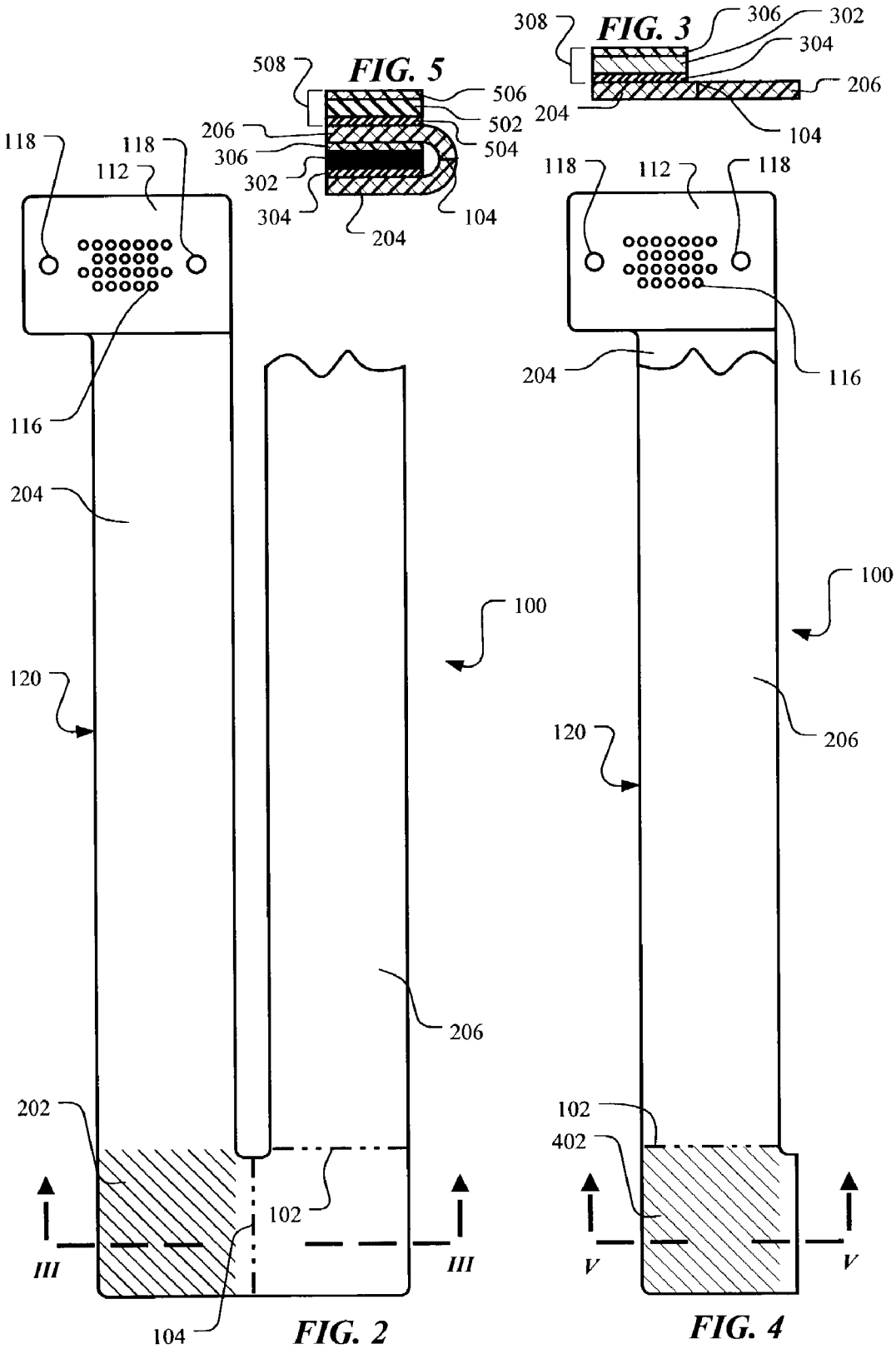
FIG. 2 is a stylized top, plan view of a portion of the cable of FIG. 1 illustrating a first embodiment according the present invention.
FIG. 3 is a stylized cross-sectional view of the cable of FIG. 1 taken along the line III—III in FIG. 2.
FIG. 4 is a stylized top, plan view of the cable of FIG. 2 after a first folding operation.
FIG. 5 is a stylized cross-sectional view of the cable taken along the line V—V in FIG. 4.

According to a first embodiment of the present invention, the cable 100 may be folded into an elongated form as illustrated in FIGS. 2–7. Referring to FIGS. 2 and 3, a first shim 302 is adhesively bonded to an area 202 (indicated by hatching) of the intermediate portion 120 by a first layer of adhesive 304. A second layer of adhesive 306 is then applied to the first shim 302. Alternatively, a shim assembly 308 having adhesive layers 304, 306 that have been pre-applied to the first shim 302 may be used. In this situation, the shim assembly 308 may be applied as a unit to the area 202 of the intermediate portion 120. The intermediate portion 120 is then folded along the fold line 104 so that a second leg 206 may be placed into contact with the second adhesive layer 306, thus adhesively bonding the second leg 206 to the first shim 302, as illustrated in FIGS. 4 and 5.

Figure 6:
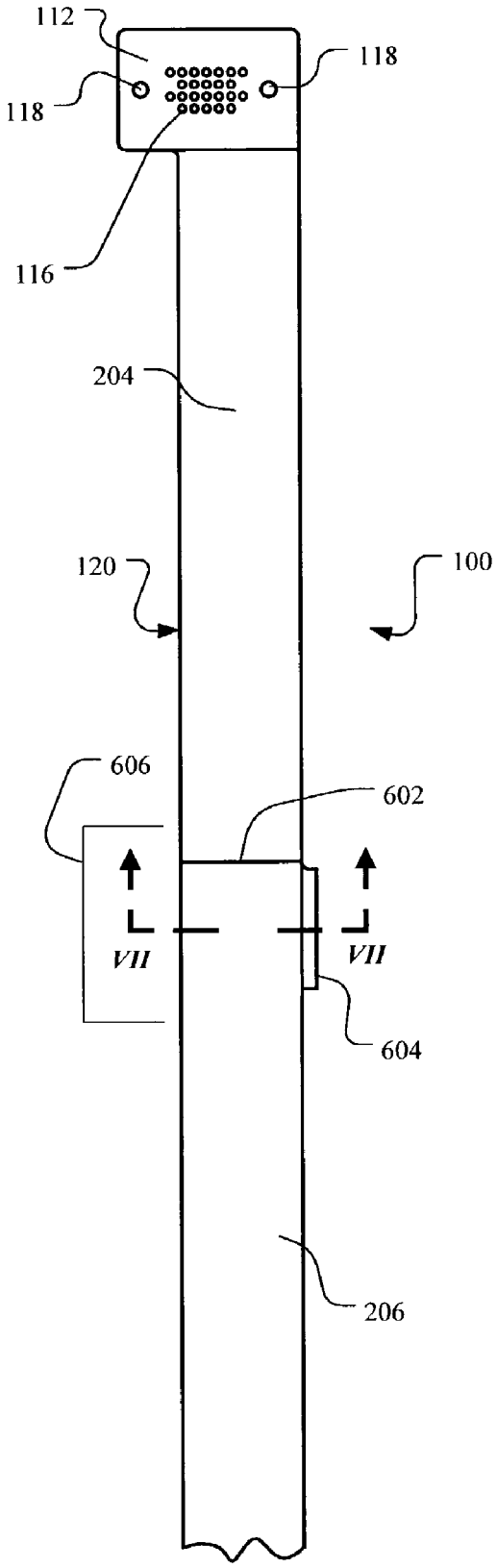
FIG. 6 is a fragmented, stylized top, plan view of the cable of FIG. 2 after a second folding operation.
Figure 7:
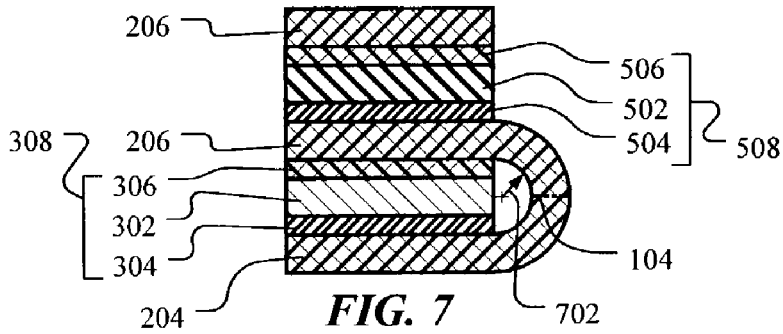
FIG. 7 is a stylized cross-sectional view of the cable taken along the VII—VII line in FIG. 6.

Still referring to FIGS. 4 and 5, a second shim 502 is bonded to an area 402 (indicated by hatching) of the intermediate portion 120 by a third layer of adhesive 504. A fourth layer of adhesive 506 is then applied to the shim 502. Alternatively, a shim assembly 508 having adhesive layers 504, 506 that have been pre-applied to the shim 502 may be used, as described above. The intermediate portion 120 is then folded along the fold line 102 so that the second leg 206 may be placed into contact with the fourth adhesive layer 506, thus adhesively bonding the second leg 206 to the second shim 502 and forming the cable into an elongated form, as depicted in FIGS. 6 and 7.

The shims 302, 502 are provided so that, upon folding the intermediate portion 120 along the fold lines 102, 104, adequate bend radii (e.g., the bend radius 702 of FIG. 7) are provided to minimize the likelihood of breaking the conductors 122 within the cable 100. In one embodiment, the bend radius 702 is at least about two times the thickness of the intermediate portion 120. Thus, the combined thickness of the first adhesive layer 304, the first shim 302, and the second adhesive layer 306 (or the thickness of the shim assembly 308, if used) is at least about two times the thickness of the intermediate portion 120. Such a thickness also generally applies to the third adhesive layer 504, the second shim 502, and the fourth adhesive layer 506.

Figure 8:
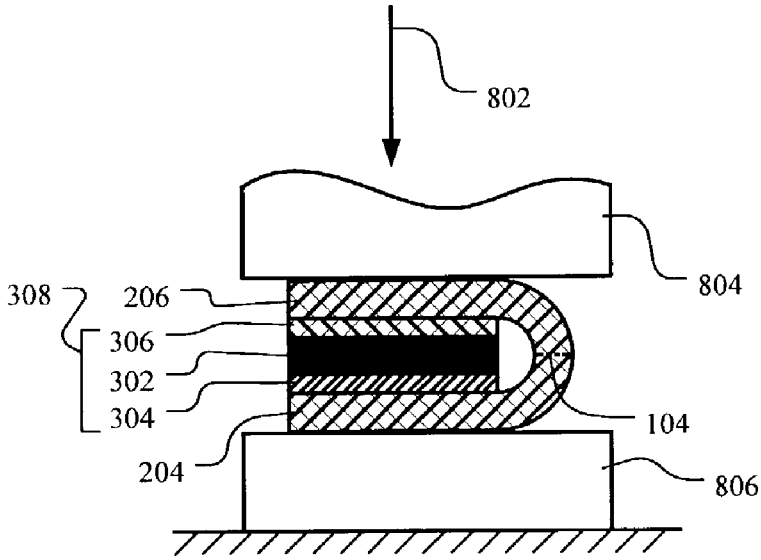
FIG. 8 is a stylized partial cross-sectional view illustrating a first pressing operation according to the present invention.
Figure 9:
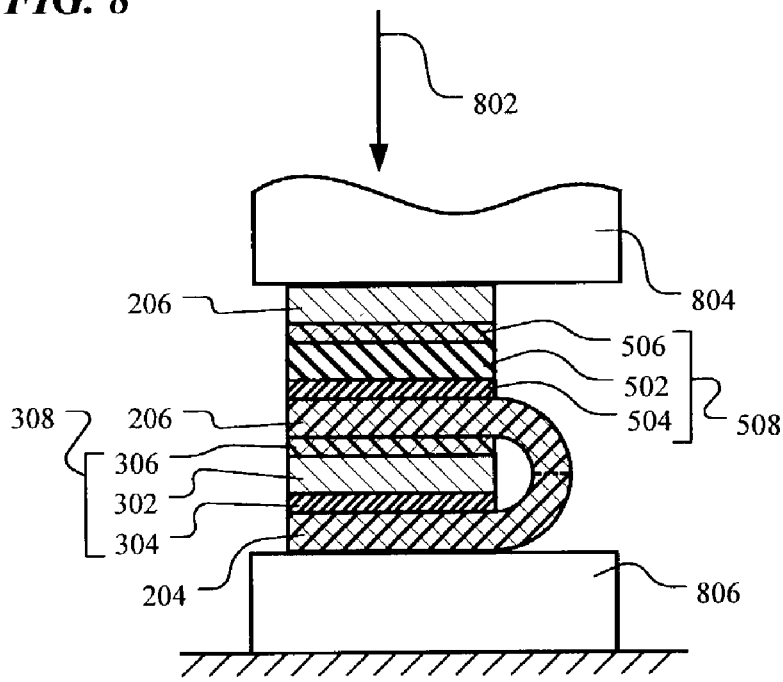
FIG. 9 is a stylized partial cross sectional view illustrating a second pressing operation according to the present invention.

In one embodiment, the cable 100 may be pressed together (as indicated by arrow 802) after the first fold is made (along the fold line 104) between platens 804, 806 to adhesively bond the assembly together, as illustrated in FIG. 8. The platens 804, 806 may be heated so that heat may be transmitted into the cable 100 to cure the adhesive layers 304, 306. The same method and apparatus may be used to press the cable 100 after the second fold is made (along the fold line 102), as illustrated in FIG. 9. However, the invention is not so limited and pressing the folded cable 100 may be omitted in some embodiments.

Figure 10:
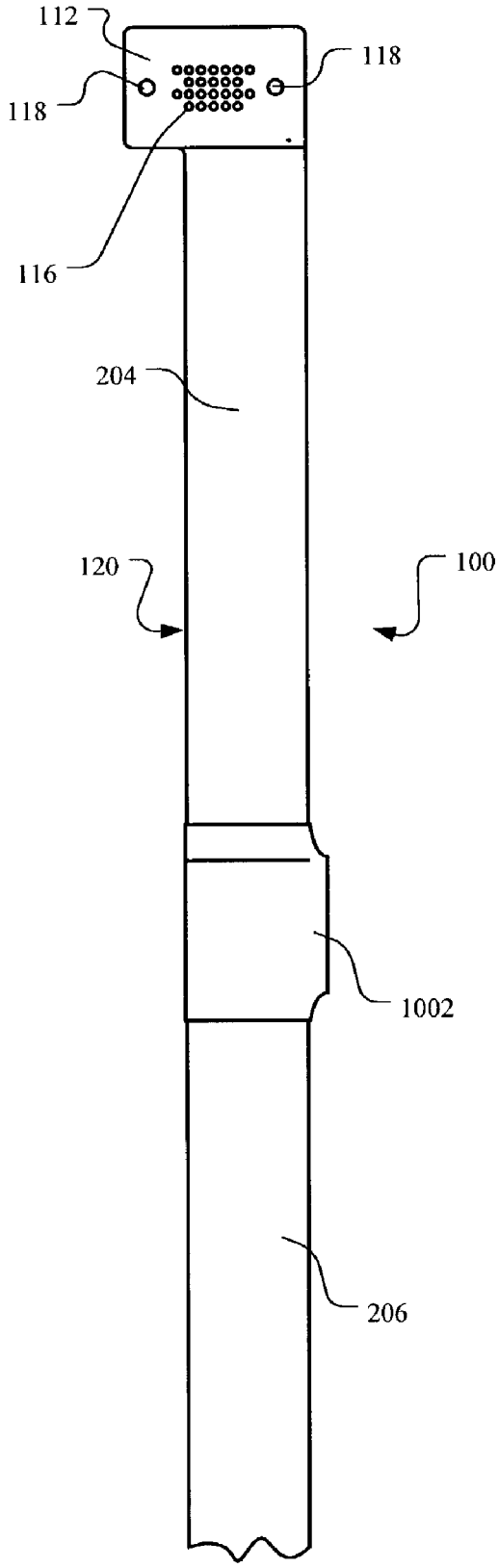
FIG. 10 is a fragmented, stylized top view of the cable of FIG. 6 having a sleeve applied to the fold area thereof.

Referring again to FIG. 6, folds 602, 604 produced by folding the intermediate portion 120 about the fold lines 102, 104 (shown in FIG. 1), respectively, may, in certain situations, interfere with or catch on adjacent structures as the cable 100 is being installed. Accordingly, in the embodiment illustrated in FIG. 10, a sleeve 1002 is fitted around the fold area 606 so that the risk of interfering with or catching on adjacent structures may be reduced. In one embodiment, the sleeve 1002 is a heat-shrinkable polymeric tube, such as Sigmaform™ tubing manufactured by Tyco Electronics Corporation of Menlo Park, Calif. In this embodiment, the sleeve 1002 is placed around the fold area 606 and heat is applied thereto, such as by a hot air gun, a heating element, or the like, to shrink and generally conform the sleeve 1002 to the shape of the fold area 606. Further, the sleeve 1002 may reinforce the fold area 606 by reducing the stress on the folds and generally improving the overall structural integrity of the fold area 606.

In another embodiment, the sleeve 1002 is a heat-shrinkable polymeric tube, as described above, having an adhesive layer (not shown) disposed on the inner surface thereof, such as high ratio tubing manufactured by XL Technologies of Kernersville, N.C. In this embodiment, the sleeve 1002 is placed around the fold area 606 and heat is applied thereto, as described above, to shrink and conform the sleeve 1002 to the shape of the fold area 606 and to also adhesively bond the inner surface of the sleeve 1002 to the cable 100.

Figure 12:
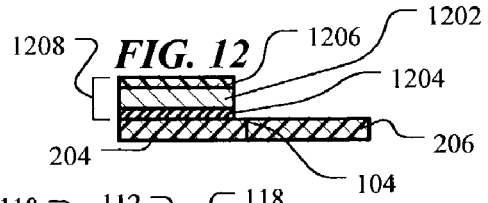
FIG. 12 is a stylized cross-sectional view of the cable taken along the line XII—XII of FIG. 11.
Figure 14:
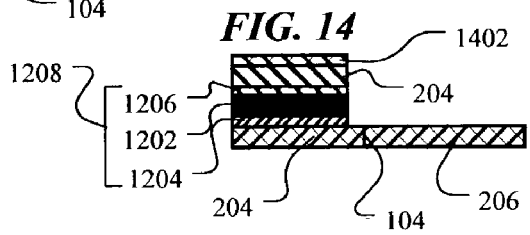
FIG. 14 is a stylized cross-sectional view of the cable taken along the line XIV—XIV of FIG. 13.
Figure 11:
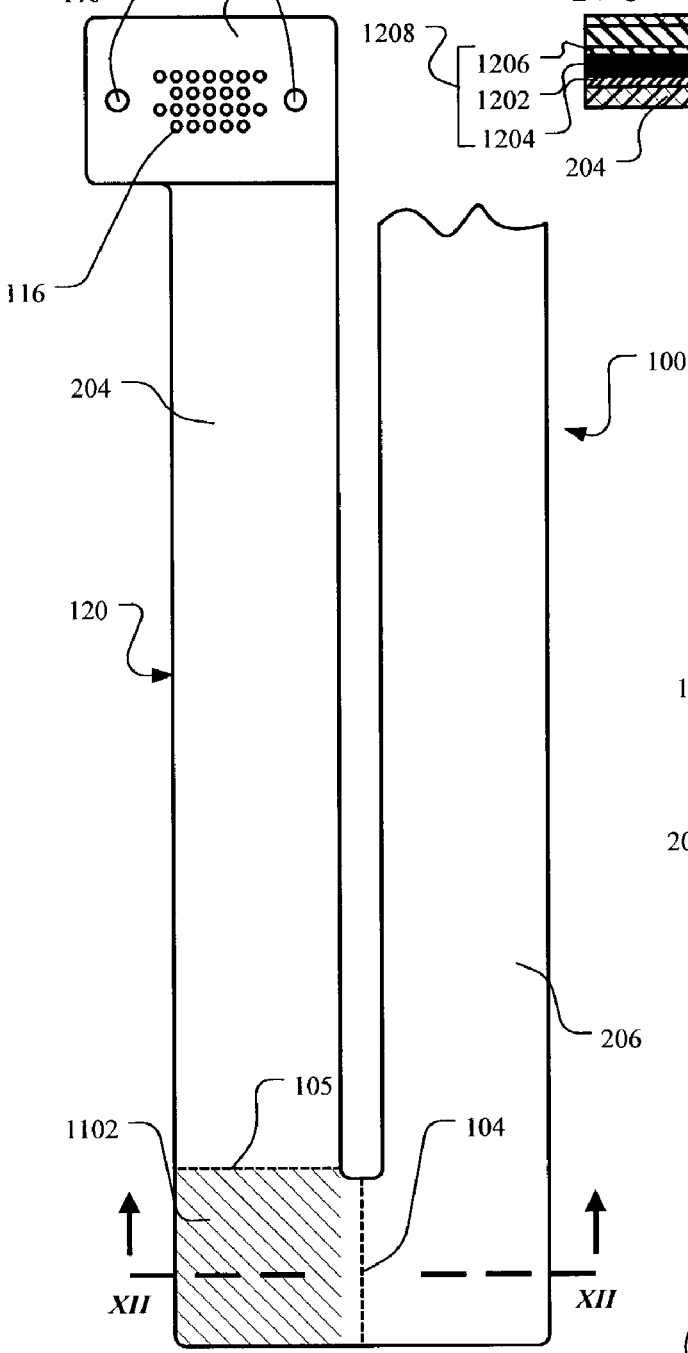
FIG. 11 is a stylized top view of a portion of the cable of FIG. 1 illustrating a second embodiment according to the present invention.
Figure 13:
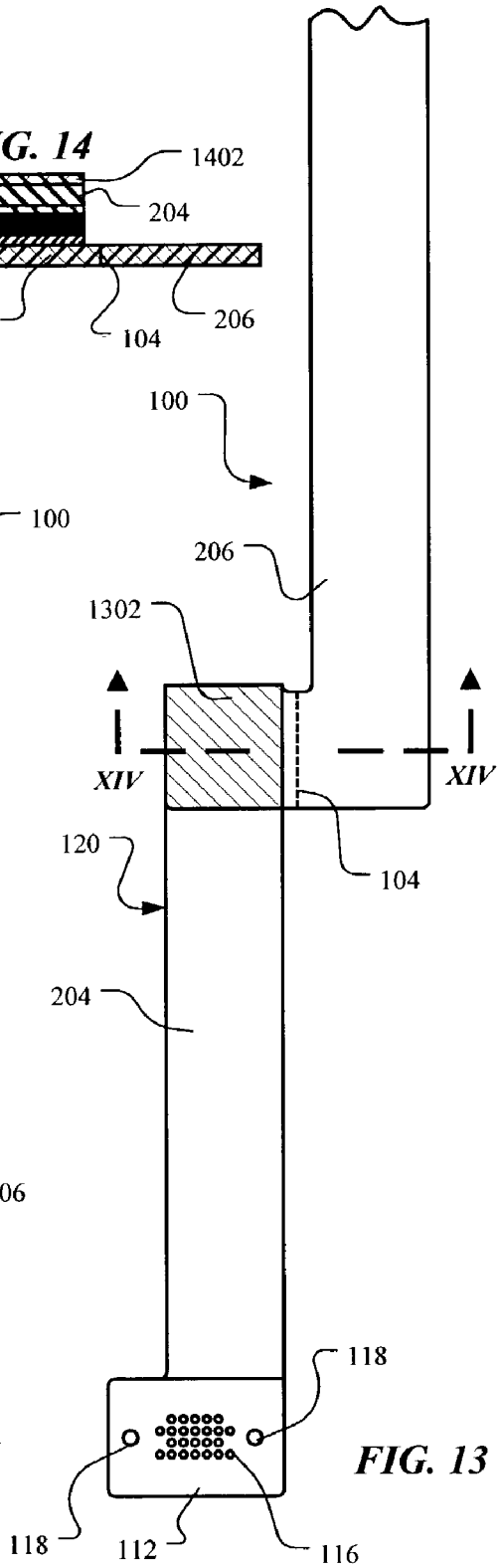
FIG. 13 is a stylized top view of the cable of FIG. 11 after a first folding operation.

Alternatively, it may be desirable to decrease the number of shims over the embodiment illustrated in FIGS. 2–7. Thus, according to a second embodiment of the present invention, the cable 100 may be folded into an elongated form as illustrated in FIGS. 11–16. Referring to FIGS. 11 and 12, a shim 1202 is bonded to an area 1102 (indicated by hatching) of the intermediate portion 120 by a first layer of adhesive 1204. A second layer of adhesive 1206 is then applied to the shim 1202. Alternatively, a shim assembly 1208 having adhesive layers 1204, 1206 that have been pre-applied to the shim 1202 may be used. In this situation, the shim assembly 1208 may be applied as a unit to the area 1202 of the intermediate portion 120. The intermediate portion 120 is then folded along the fold line 105 so that a first leg 204 is placed into contact with the second adhesive layer 1206, thus adhesively bonding the first leg 204 to the shim 1202, as illustrated in FIGS. 13 and 14.

Figure 16:
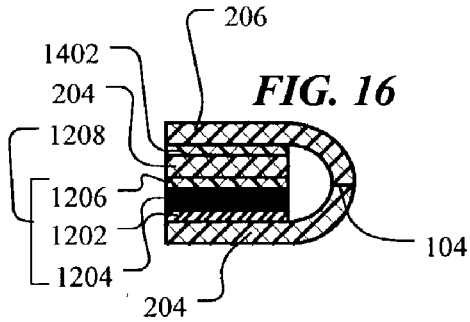
FIG. 16 is a stylized cross-sectional view of the cable taken along the line XVI—XVI of FIG. 15.
Figure 15:
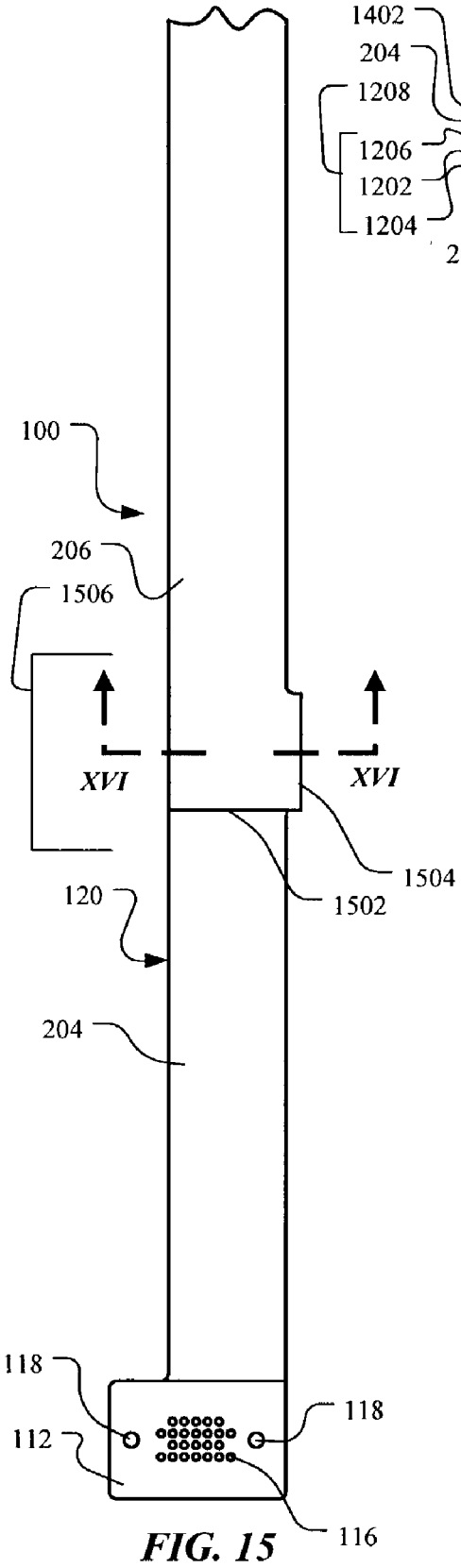
FIG. 15 is a fragmented, stylized top view of the cable of FIG. 11 after a second folding operation.

Still referring to FIGS. 13 and 14, a third layer of adhesive is applied to an area 1302 (indicated by hatching) of the intermediate portion 120. The intermediate portion 102 is then folded along the fold line 104 so that the second leg 206 may be placed into contact with the third adhesive layer 1302, thus adhesively bonding the second leg 206 to the first leg 204, as illustrated in FIGS. 15 and 16.

The shim 1202 is provided so that, upon folding the intermediate portion 120 along the fold line 105, an adequate bend radius is provided to minimize the likelihood of breaking the conductors 122 within the cable 100 as described previously relative to FIG. 7. Generally, the thickness of the first adhesive layer 1104, the shim 1102, and the second adhesive layer 1106 corresponds to the thickness of the shim/adhesive layer combinations described relative to the first embodiment (shown in FIGS. 2–7). In this embodiment, the bonded structure formed as a result of folding the intermediate portion 120 along the fold line 105 acts as a shim for the second fold (along the fold line 104), so an additional shim may be omitted while providing an adequate bend radius. The scope of the present invention, however, encompasses the addition of a shim for the second fold (i.e., the fold along the fold line 104).

In one embodiment, the cable 100 may be pressed together after the first fold is made (along fold line 105), as described previously relative to FIG. 8. Further, the cable 100 may be pressed together after the second fold is made (along the fold line 104), as described previously relative to FIG. 9.

Figure 17:
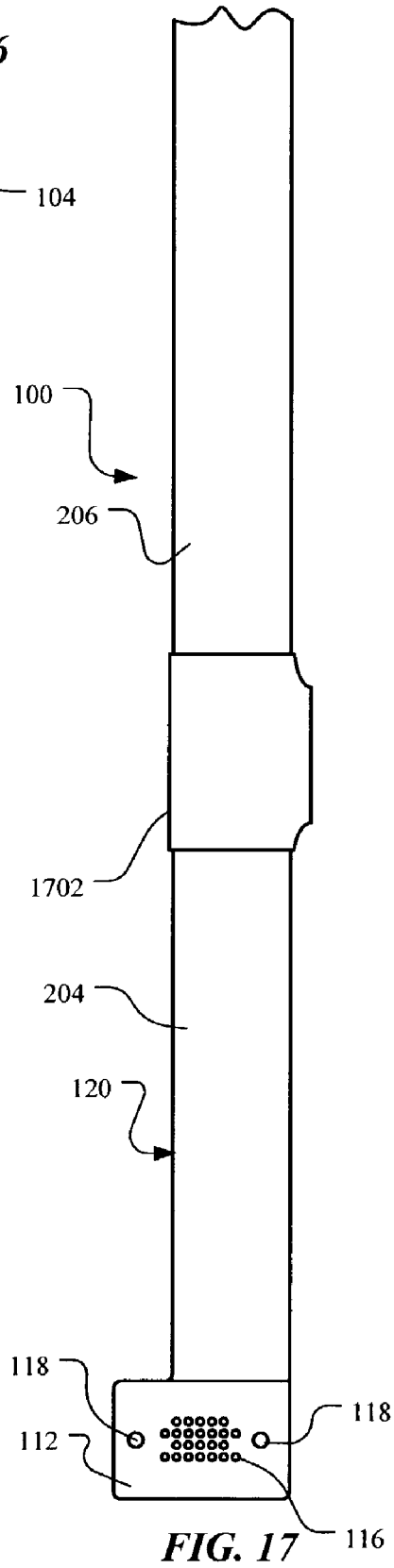
FIG. 17 is a fragmented, stylized top view of the cable of FIG. 15 having a sleeve applied to a fold area thereof.

Referring again to FIG. 15, folds 1502, 1504 produced by folding the intermediate portion 120 about the fold lines 105, 104 (shown in FIG. 1), respectively, may interfere with or catch on adjacent structures as the cable 100 is being installed. Accordingly, in the embodiment illustrated in FIG. 17, a sleeve 1702 is fitted around the fold area 1506 so that the risk of interfering with or catching on adjacent structures may be reduced. The sleeve 1702 may generally have the same characteristics as the sleeve 1002, shown in FIG. 10.

Figure 18:
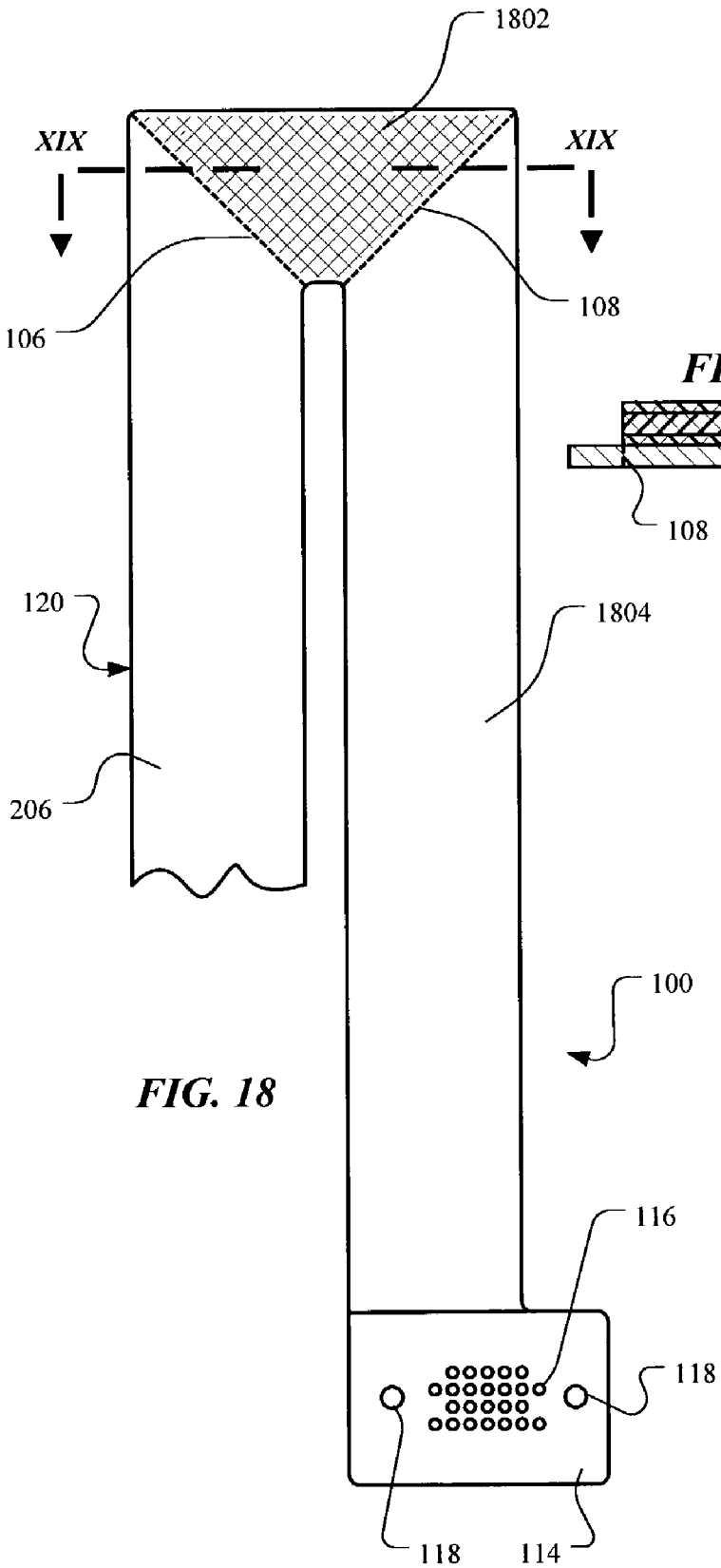
FIG. 18 is a stylized top view of a portion of the cable of FIG. 1 illustrating a third embodiment according to the present invention.
Figure 19:
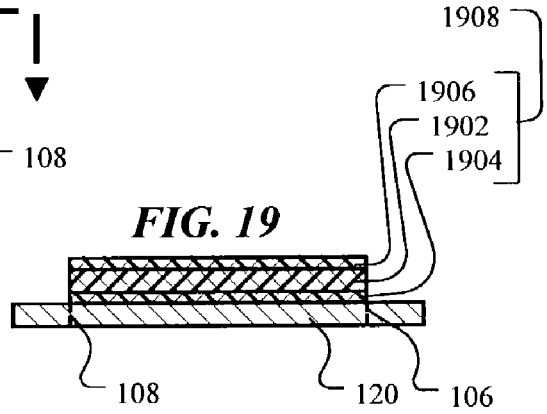
FIG. 19 is a stylized cross-sectional view of the cable taken along the line XIX—XIX of FIG. 18.
Figures 20, 21:
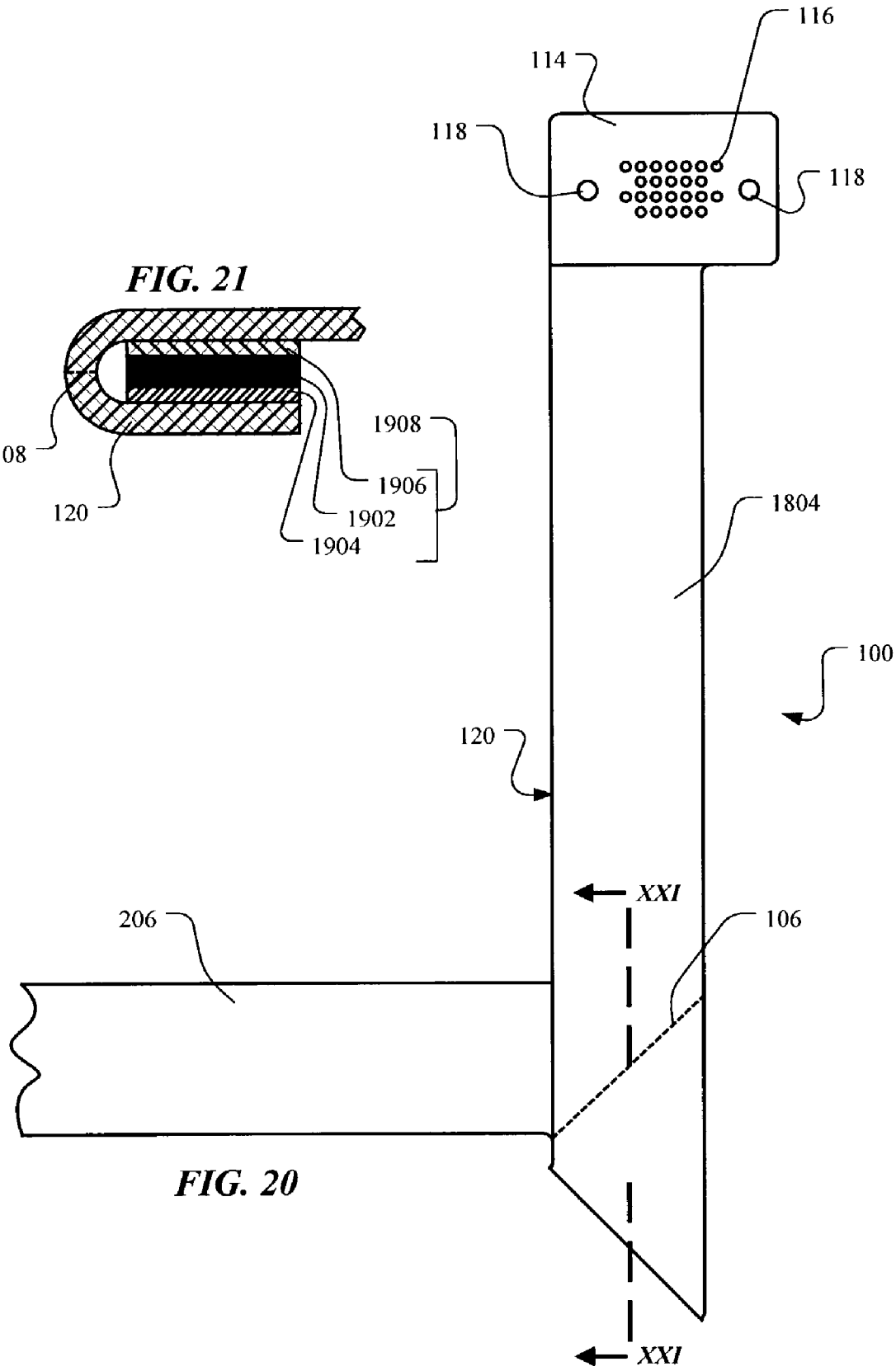
FIG. 20 is a fragmented, stylized top view of the cable of FIG. 18 after a first folding operation.
FIG. 21 is a stylized cross-sectional view of the cable taken along the line XXI—XXI in FIG. 20.

It may be desirable in certain situations to fold the cable 100 diagonally, rather than generally perpendicular to the side edges of the cable 100. Thus, according to a third embodiment of the present invention, the cable 100 may be folded into an elongated form as illustrated in FIGS. 18–25. Referring to FIGS. 18 and 19, a first shim 1902 is bonded to an area 1802 (indicated by hatching) of the intermediate portion 120 by a first layer of adhesive 1904. A second layer of adhesive 1906 is then applied to the first shim 1902. Alternatively, a shim assembly 1908 having adhesive layers 1904, 1906 that have been pre-applied to the first shim 1902 may be used. In this situation, the shim assembly 1908 may be applied as a unit to the area 1802. The intermediate portion 120 is then folded along the fold line 108 so that a third leg 1804 may be placed into contact with the second adhesive layer 1906, thus adhesively bonding the third leg 1804 to the first shim 1902, as illustrated in FIGS. 20 and 21.

Figures 22, 23, 25:
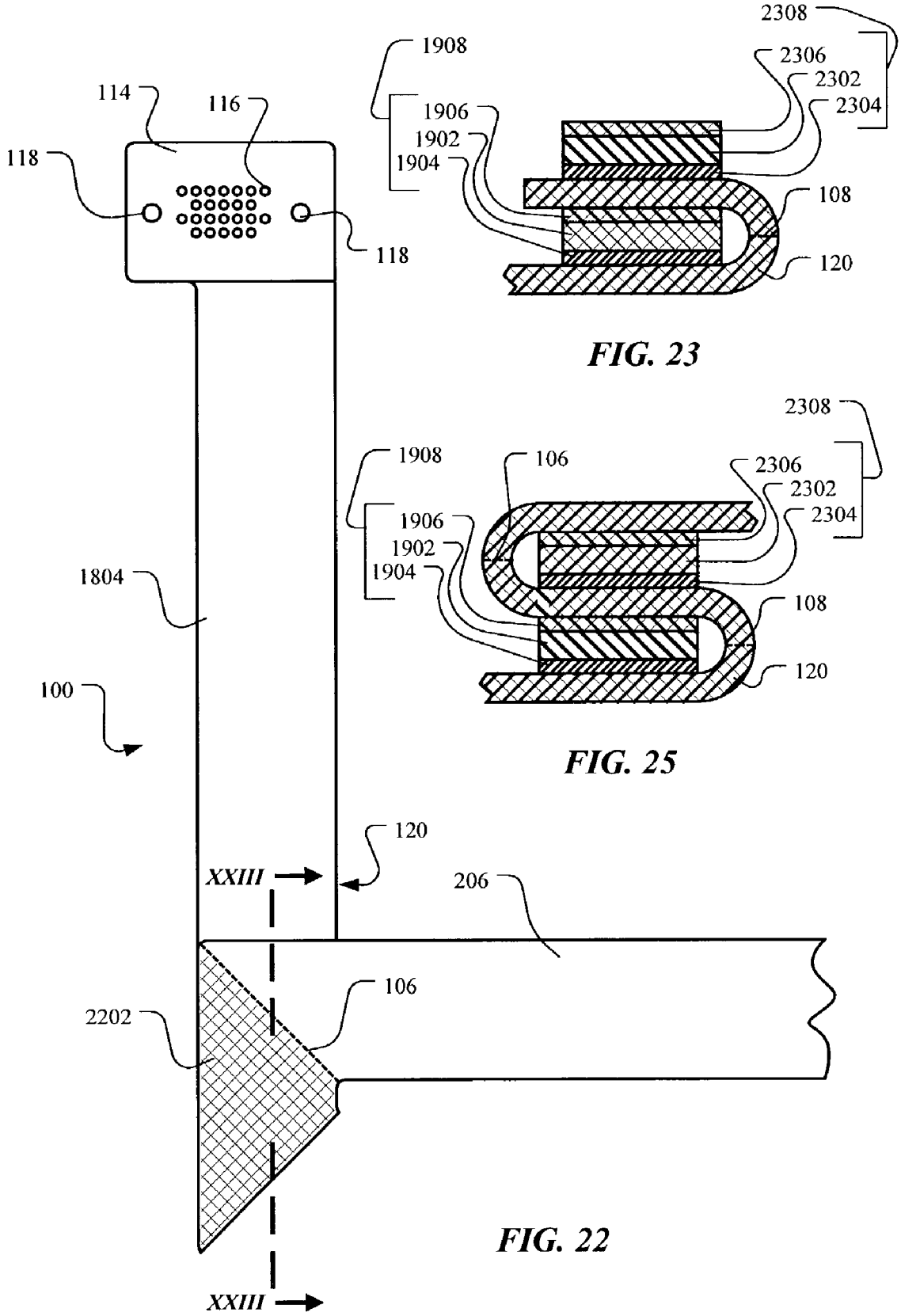
FIG. 22 is a fragmented, stylized bottom view of the cable of FIG. 20.
FIG. 23 is a stylized cross-sectional view of the cable taken along the line XXIII—XXIII in FIG. 22.
FIG. 25 is a stylized cross-sectional view of the cable taken along the line XXV—XXV in FIG. 24.
Figure 24:
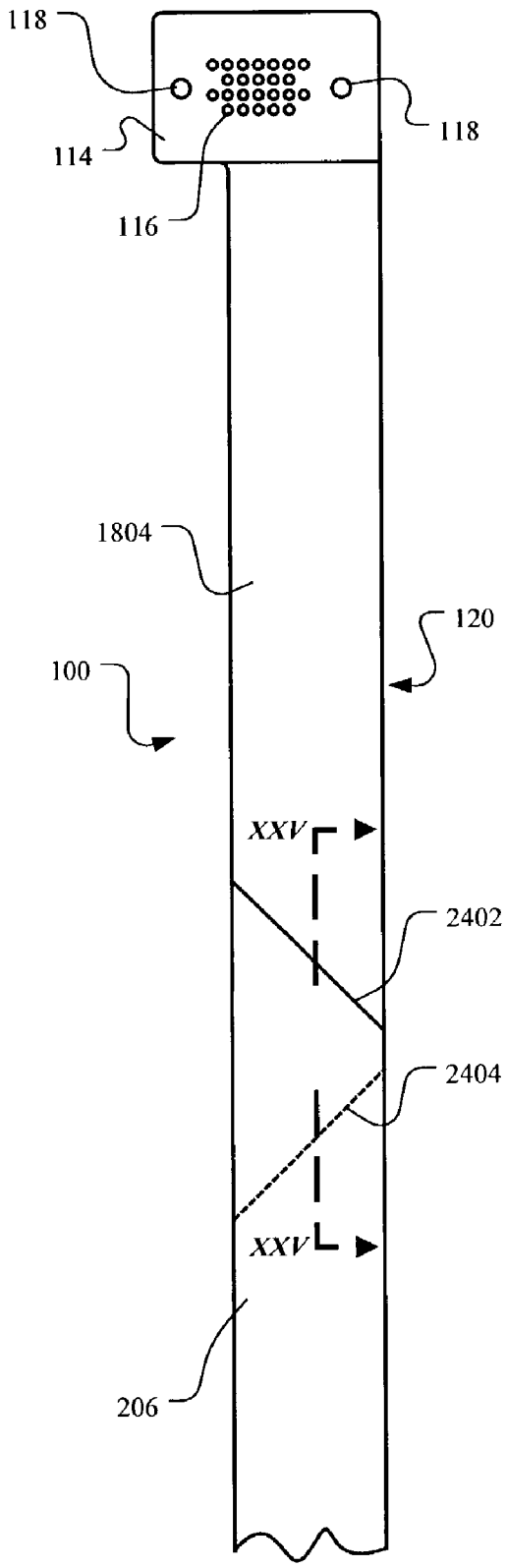
FIG. 24 is a fragmented, stylized bottom view of the cable of FIG. 18 after a second folding operation.

Referring now to FIGS. 22 and 23, a second shim 2302 is bonded to an area 2202 (indicated by hatching) of the intermediate portion 120 by a third layer of adhesive 2304. A fourth layer of adhesive 2306 is then applied to the shim 2302. Alternatively, a shim assembly 2308 having adhesive layers 2304, 2306 that have been pre-applied to the shim 2302 may be used, as described above. The intermediate portion 120 is then folded along the fold line 106 so that the third leg 1804 may be placed into contact with the fourth adhesive layer 2306, thus adhesively bonding the third leg 1804 to the second shim 2302 and forming the cable into an elongated form, as depicted in FIGS. 24 and 25.

Each of the shims 1902, 2302 are provided so that, upon folding the intermediate portion 120 along the fold lines 106, 108, adequate bend radii are provided to minimize the likelihood of breaking the conductors 122 within the cable 100, as described previously relative to FIG. 7. Generally, the thickness of the first adhesive layer 1904, the first shim 1902, and the second adhesive layer 1906, as well as the thickness of the third adhesive layer 2304, the second shim 2302, and the fourth adhesive layer 2306, corresponds to the thickness of the shim/adhesive layer combinations described relative to the first and second embodiments (shown in FIGS. 2–6 and FIGS. 11–25, respectively).

In one embodiment, the cable 100 may be pressed together after the first fold is made (along fold line 108), as described previously relative to FIG. 8. Further, the cable 100 may be pressed together after the second fold is made (along the fold line 106), as described relative to FIG. 9.

Figure 26:
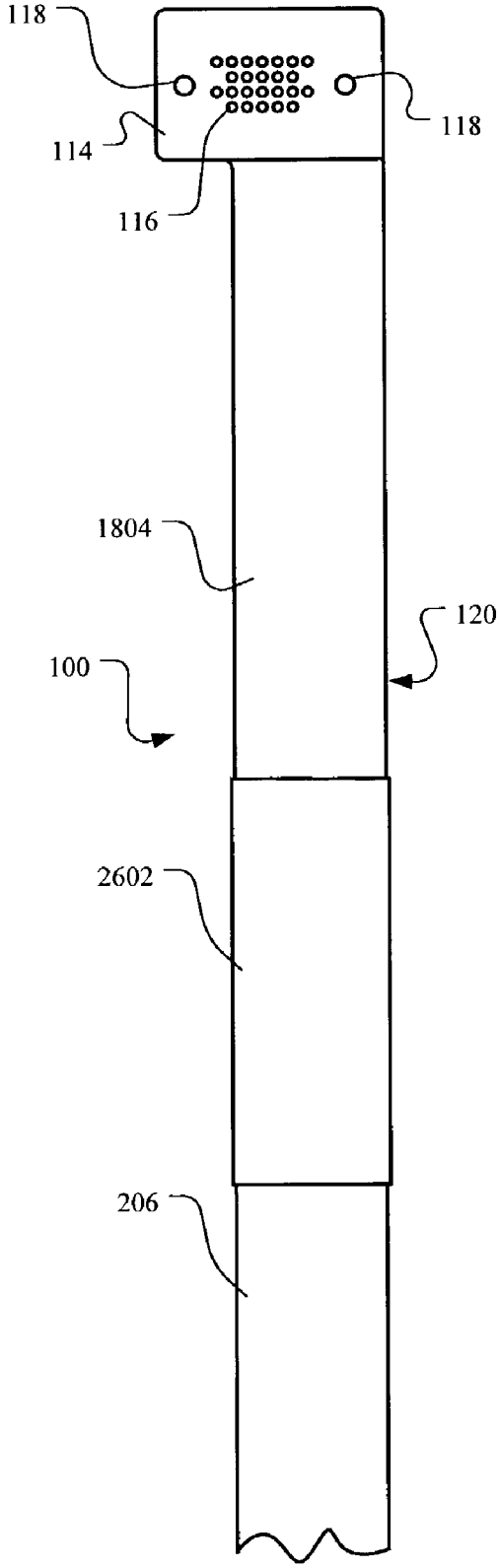
FIG. 26 is a fragmented, stylized bottom view of the cable of FIG. 24 having a sleeve applied to a fold area thereof.

Referring again to FIG. 24, folds 2402, 2404, produced by folding the intermediate portion 120 along the fold lines 106, 108, respectively, may interfere with or catch on adjacent structures as the cable 100 is being installed. Accordingly, in the embodiment illustrated in FIG. 26, a sleeve 2602 is fitted around the fold area 2406 so that the risk of interfering with or catching on adjacent structures may be reduced. The sleeve 2602 may generally have the same characteristics as the sleeve 1002, shown in FIG. 10.

The shims 302, 502, 1202, 1902, 2302, as illustrated in FIGS. 3, 5, 12, 19, and 23, may be made of a glass-filled epoxy material, such as 45N glass-reinforced epoxy laminate manufactured by Arlon Materials for Electronics of Rancho Cucamonga, Calif. The adhesive layers 304, 306, 504, 406, 1204, 1206, 1402, 1904, 1906, 2304, 2306, as illustrated in FIGS. 3, 5, 12, 14, 19, and 23, may be made of a pressure-sensitive acrylic material, such as MACbond™ acrylic-coated polyester film manufactured by MACtac U.S.A. of Stow, Ohio or VHB™ acrylic foam tape manufactured by 3M Company. The scope of the present invention, however, encompasses the use of any desired shim and/or adhesive material or combination that will provide an adequate bend radius in a folded cable, as described previously relative to FIG. 7.

Figure 27:
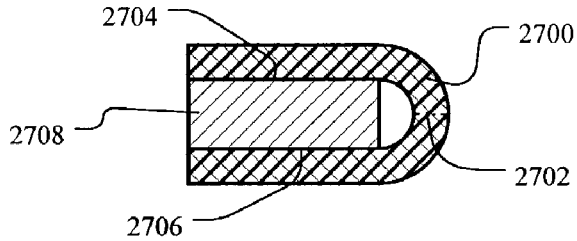
FIG. 27 is a stylized cross-sectional view of a cable having a filled adhesive shim within a fold thereof.

For example, it may be desirable to combine the adhesive bonding and shimming functions into one structure, rather than having a separate shim and adhesive layers as previously disclosed. Accordingly, as illustrated in cross-section in FIG. 27, a cable 2700 may be folded along a fold line 2702 and the inner surfaces 2704, 2706 adhesively bonded to one another by using a filled adhesive film 2708. The filled adhesive film 2708 may be made from a pressure-sensitive adhesive that is filled with particles, fibers, or microballoons made from a material such as glass.

Figure 28:
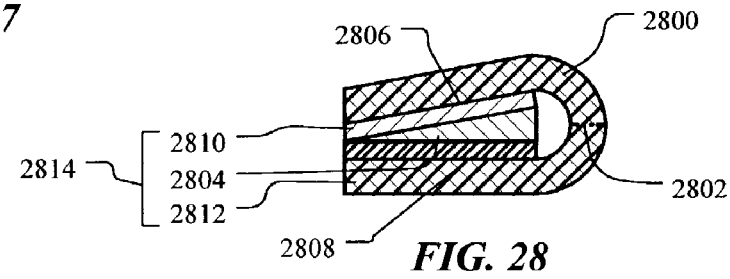
FIG. 28 is a stylized cross-sectional view of a cable having a wedge-shaped shim within a fold thereof.

Further, it may be desirable to decrease the volume taken up by the fold. As illustrated in FIG. 28, a cable 2800 may be folded along a fold line 2802 and a wedge-shaped shim 2804 adhesively bonded in the fold to the interior surfaces 2806, 2808 defined by the fold. In the illustrated embodiment, adhesive layers 2810, 2812 adhesively bond the shim 2804 to the interior surfaces 2806, 2808. The shim 2804 and adhesive layers 2810, 2812 may be made of any known materials, as described above. Further, the adhesive layers 2810, 2812 may be pre-applied to the shim 2804 to form a shim assembly 2814.

Figure 29:
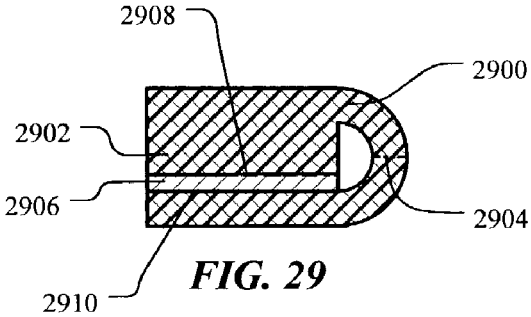
FIG. 29 is a stylized cross-sectional view of a cable having an integral shim therein.

In certain circumstances, it may be desirable to incorporate a shim into a cable, rather than providing a separate shim as disclosed previously. As illustrated in FIG. 29, the cable 2900 further includes a shim portion 2902 that is integral with the cable 2900. The cable 2900 may be folded along a fold line 2904. An adhesive layer 2906 bonds the inner surfaces 2908, 2910 of the cable 2900. The adhesive layer 2906 may be made of any known material, as described above.

While the cable 100 is described herein as having shims bonded in particular locations and being folded in particular ways, the present invention is not so limited. Rather, the scope of the present invention encompasses various combinations of shim locations and/or fold configurations and fold orders that provide a folded cable having one or more folds with adequate bend radii to inhibit the likelihood of breaking conductors within the cable as a result of folding. Further, while the cable 100 is illustrated herein as having a generally straight form after folding, the cable 100 may be folded into any desired shape.

Figure 30:
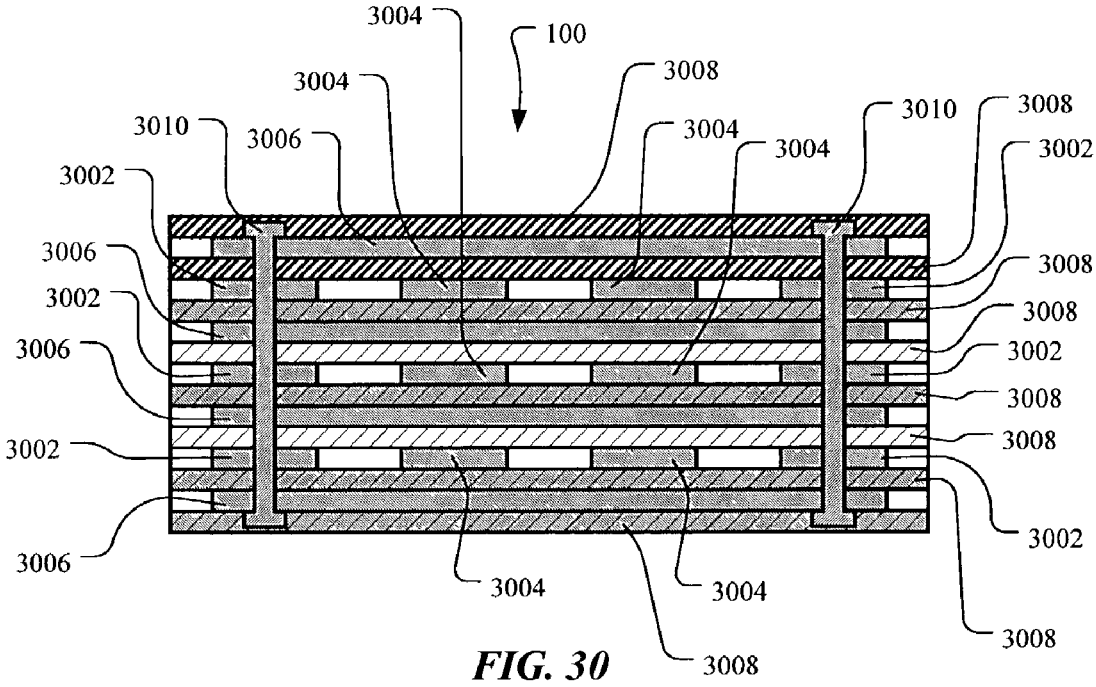
FIG. 30 is a stylized cross-sectional view of the cable taken along the line XXX—XXX in FIG. 1.

FIG. 30 illustrates in cross-section an embodiment of the cable 100 having a plurality of edge conductors 3002 and a plurality of central conductors 3004 disposed between shielding conductors 3006, which can be folded according to the present invention as described above. The edge conductors 3002, the central conductors 3004, and the shielding conductors 3006 are electrically insulated by a plurality of insulating layers 3008. The shielding conductors 3006 and the edge conductors 3002 are electrically coupled by vias 3010, which are spaced along the length of the cable 100. The central conductors 3004 are used to transmit data signals through the cable 100, while the shielding conductors 3006, in combination with the edge conductors 3002 and the vias 3010, protect the central conductors 3004 from electromagnetic interference external to the cable 100 and inhibit electromagnetic interference from radiating from the cable 100. Thus, the combination of the shielding conductors 3006, the edge conductors 3002, and the vias 3010 surround each layer of central conductors 3004 with an electromagnetic interference shield.

While the illustrated embodiment provides a shielding conductor 3006 between each layer of central conductors 3004, the scope of the present invention encompasses a cable wherein shielding conductors 3006 are omitted from between the layers of central conductors 3004. Rather, in such an embodiment, the combination of the shielding conductors 3006, the edge conductors 3002, and the vias 3010 surround the plurality of layers of central conductors 3004. Further, the present invention includes a cable (e.g., the cable 100) that omits some or all of the edge conductors 3002, the shielding conductors 3006, and the vias 3010. For example, the cable 100 may include only the central conductors 3004 and the insulating layers 3008.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A cable, comprising:

a first portion;

a second portion;

a first fold between the first portion and the second portion;

a first shim bonded between the first portion and the second portion;

a third portion; and a second fold between the second portion and the third portion, wherein the first portion is bonded to the third portion.

2. A cable, according to claim 1, wherein the first fold has a radius of at least about two times a thickness of the cable within the first fold.

3. A cable, according to claim 1, wherein the first shim is bonded to an upper surface of the first portion by a first adhesive layer and to a lower surface of the second portion by a second adhesive layer.

4. A cable, according to claim 3, wherein at least one of the first and second adhesive layers comprises a pressure-sensitive acrylic layer.

5. A cable, according to claim 3, wherein the first adhesive layer, the first shim, and the second adhesive layer have a combined thickness of at least about two times a thickness of the cable within the first fold.

6. A cable, according to claim 1, wherein the first shim comprises a wedge-shaped shim.

7. A cable, according to claim 1, wherein the first shim comprises a glass-filled epoxy material.

8. A cable, according to claim 1, wherein the second fold has a radius of at least about two times a thickness of the cable within the second fold.

9. A cable, according to claim 1, further comprising a second shim bonded between the first portion and the third portion.

10. A cable, according to claim 9, wherein the second shim is bonded to a lower surface of the first portion by a third adhesive layer and to an upper surface of the third portion by a fourth adhesive layer.

11. A cable, according to claim 10, wherein at least one of the third and fourth adhesive layers comprises a pressure-sensitive acrylic layer.

12. A cable, according to claim 10, wherein the third adhesive layer, the second shim, and the fourth adhesive layer have a combined thickness of at least about two times a thickness of the cable within the second fold.

13. A cable, according to claim 9, wherein the second shim comprises a wedge-shaped shim.

14. A cable, according to claim 9, wherein the second shim comprises a glass-filled epoxy material.

15. A cable, according to claim 9, wherein the first shim is bonded between the first portion and the second portion by a pressure-sensitive acrylic.

16. A cable, according to claim 9, wherein the first shim is integral with the cable.

17. A cable, according to claim 9, wherein the first shim comprises a filled adhesive material.

18. A cable, according to claim 1, wherein the first portion is bonded to the third portion by a pressure-sensitive acrylic.

19. A cable, according to claim 1, wherein the second shim is bonded between the first portion and the third portion by a pressure-sensitive acrylic.

20. A cable, according to claim 1, wherein the second shim is integral with the cable.

21. A cable, according to claim 1, wherein the second shim comprises a filled adhesive material.

22. A cable, according to claim 1, further comprising a sleeve disposed about the first and second folds.

23. A cable, comprising:

a first portion;

a second portion;

a first fold between the first portion and the second portion;

a first shim bonded between the first portion and the second portion;

a conductor;

a first shielding layer disposed above the conductor;

a second shielding layer disposed below the conductor;

a first edge conductor disposed laterally in a first direction from the conductor;

a second edge conductor disposed laterally in a second direction, opposite from the first direction, from the conductor;

a first via electrically coupling the first shielding layer, the first edge conductor, and the second shielding layer; and a second via electrically coupling the first shielding layer, the second edge conductor, and the second shielding layer.

24. A cable, according to claim 23, wherein the first shim is bonded between the first portion and the second portion by a pressure-sensitive acrylic.

25. A cable, according to claim 23, wherein the cable further comprises:

a third portion;

a second fold between the second portion and the third portion; and a second shim bonded between the second portion and the third portion.

26. A cable, according to claim 25, wherein the second fold has a radius of at least about two times a thickness of the cable within the second fold.

27. A cable, according to claim 25, wherein the second shim is bonded to an upper surface of the second portion by a third adhesive layer and to a lower surface of the third portion by a fourth adhesive layer.

28. A cable, according to claim 27, wherein at least one of the third and fourth adhesive layers comprises a pressure-sensitive adhesive layer.

29. A cable, according to claim 27, wherein the third adhesive layer, the second shim, and the fourth adhesive layer have a combined thickness of at least about two times a thickness of the cable within the second fold.

30. A cable, according to claim 25, wherein the second shim comprises a wedge-shaped shim.

31. A cable, according to claim 25, wherein the second shim comprises a glass-filled epoxy material.

32. A cable, according to claim 25, wherein the second shim is bonded between the second portion and the third portion by a pressure-sensitive acrylic.

33. A cable, according to claim 25, wherein the second shim is integral with the cable.

34. A cable, according to claim 25, wherein the second shim comprises a filled adhesive material.

35. A cable, according to claim 23, wherein the first shim is integral with the cable.

36. A cable, according to claim 23, wherein the first shim further comprises a wedge-shaped shim.

37. A cable, according to claim 23, wherein the first shim further comprises a filled adhesive layer.

38. A cable, according to claim 23, further comprising:

a third portion; and a second fold between the second portion and the third portion, wherein the first portion is bonded to the third portion.

39. A cable, according to claim 38, wherein the second fold has a radius of at least about two times a thickness of the cable within the second fold.

40. A cable, according to claim 38, further comprising a second shim bonded between the first portion and the third portion.

41. A cable, according to claim 40, wherein the second shim is bonded to a lower surface of the first portion by a third adhesive layer and to an upper surface of the third portion by a fourth adhesive layer.

42. A cable, according to claim 41, wherein at least one of the third and fourth adhesive layers comprises a pressure-sensitive acrylic layer.

43. A cable, according to claim 41, wherein the third adhesive layer, the second shim, and the fourth adhesive layer have a combined thickness of at least about two times a thickness of the cable within the second fold.

44. A cable, according to claim 40, wherein the second shim comprises a wedge-shaped shim.

45. A cable, according to claim 40, wherein the second shim comprises a glass-filled epoxy material.

46. A cable, according to claim 23, wherein the first fold has a radius of at least about two times a thickness of the cable within the first fold.

47. A cable, according to claim 23, wherein the first shim is bonded to an upper surface of the first portion by a first adhesive layer and to a lower surface of the second portion by a second adhesive layer.

48. A cable, according to claim 47, wherein the first adhesive layer, the first shim, and the second adhesive layer have a combined thickness of at least about two times a thickness of the cable within the first fold.

49. A cable, according to claim 23, wherein the first shim comprises a glass-filled epoxy material.

50. A cable, according to claim 23, further comprising a sleeve disposed about the first fold.

51. A cable, comprising:

a body comprising at least one conductor and having a fold, extending across the at least one conductor, with a bend radius;

means for defining the bend radius of the fold;

a first shielding layer disposed above the conductor;

a second shielding layer disposed below the conductor;

a first edge conductor disposed laterally in a first direction from the conductor;

a second edge conductor disposed laterally in a second direction, opposite from the first direction, from the conductor;

a first via electrically coupling the first shielding layer, the first edge conductor, and the second shielding layer; and a second via electrically coupling the first shielding layer, the second edge conductor, and the second shielding layer.

52. A cable, according to claim 51, wherein the body includes a second fold extending across the at least one conductor and having a bend radius, the cable further comprising means for defining the bend radius of the second fold.

53. A method for making a cable, comprising:

creating a first fold between a first portion and a second portion of the cable;

bonding a first shim between the first portion and the second portion of the cable;

creating a second fold between the second portion of the cable and a third portion of the cable; and bonding the first portion of the cable to the third portion of the cable.

54. A method, according to claim 53, further comprising bonding a second shim between the first portion of the cable and the third portion of the cable.

* * * * *